US005711385A

United States Patent [19]

Brotherton

[11] Patent Number: 5,711,385

[45] Date of Patent: Jan. 27, 1998

[54] AUGERLESS BORING SYSTEM

[76] Inventor: Jim Brotherton, 11 S. Frontage Rd., Gold Hill, Oreg. 97525

[21] Appl. No.: 631,789

[22] Filed: Apr. 12, 1996

[51] Int. Cl.[6] ..... E21B 10/64

[52] U.S. Cl. ..... 175/257; 175/171

[58] Field of Search ..... 175/62, 73, 171, 175/257, 173

[56] References Cited

U.S. PATENT DOCUMENTS

| | | | |
|---|---|---|---|
| 2,675,213 | 4/1954 | Poole et al. | 255/20 |
| 3,132,701 | 5/1964 | Juntunen | 173/24 |
| 3,162,254 | 12/1964 | Rose | 173/148 |
| 3,174,562 | 3/1965 | Stow | 175/171 |
| 3,402,781 | 9/1968 | Sandberg | 175/171 |
| 3,507,342 | 4/1970 | Hasewend et al. | 175/62 |
| 3,540,536 | 11/1970 | Huszar | 175/65 |
| 3,869,003 | 3/1975 | Yamada et al. | 175/171 |
| 3,902,563 | 9/1975 | Dunn | 175/62 |
| 3,917,010 | 11/1975 | Fink | 175/73 |
| 3,945,443 | 3/1976 | Barnes | 175/73 |
| 4,003,440 | 1/1977 | Cherrington | 175/61 |
| 4,280,732 | 7/1981 | Haspert | 299/11 |
| 4,553,612 | 11/1985 | Durham | 175/171 X |
| 4,576,515 | 3/1986 | Morimota et al. | 175/62 X |
| 4,671,703 | 6/1987 | Schmidt | 405/184 |
| 4,719,978 | 1/1988 | Klemm | 175/171 X |
| 4,936,709 | 6/1990 | Kimura | 175/62 X |
| 5,169,264 | 12/1992 | Kimura | 405/184 |
| 5,228,525 | 7/1993 | Denney et al. | 175/171 X |
| 5,240,352 | 8/1993 | Ilomäki | 175/62 X |
| 5,316,092 | 5/1994 | Ilomaki | 175/62 |

OTHER PUBLICATIONS

Technical Evaluation Report developed by Jim Brotherton and written by Jason E. Lopez and completed on Aug. 1, 1994.

*Primary Examiner*—Frank Tsay
*Attorney, Agent, or Firm*—Marger, Johnson, et al.

[57] ABSTRACT

An augerless boring system uses a relatively slender drill steel pipe attached at a front end to a large tubular hammer. The hammer holds different drill bits. The drill steel and the hammer are located inside a casing and driven along with the casing by a power and advance unit. The hammer extends through a front stabilizer head attached to the front end of the casing. A stabilizer head improves drill bit control while supporting the boring assembly in the casing. The stabilizer head includes multiple stabilizer bars extending lengthwise along the inside of a stabilizer casing. A special thrust adapter is used for pushing the casing in a forward direction and attaches to a size adapter that provides forward pressure against substantially the entire rear end of the casing. The thrust adapter in combination with the size adapter provides even distributed pressure to the rear end of the casing for more effective thrust of the casing into a bore hole. A special flushing system is used for augerless removal of pulverized material from the casing.

22 Claims, 4 Drawing Sheets

AUGERLESS BORING SYSTEM

BACKGROUND OF THE INVENTION

This invention relates generally to boring equipment and, more particularly, to an augerless boring system that provides improved boring through a wide variety of soil compositions.

Horizontal boring systems are used to place pipe casing through a wide variety of different soil compositions. In standard boring systems, a thrust and drive unit such as shown in U.S. Pat. No. 3,162,254 to Rose is coupled to an auger. The auger is located inside sections of tubular casing. A drilling bit assembly is joined to a front end of the auger. The drive unit pushes the casing from an aft end while at the same time rotating and pushing the auger and drill bit forward through the soil. Rock and dirt is transported by the auger out a rear end of the casing.

Several problems exist with auger machines. Large cobble rocks can jam between the auger fins and the front end of the casing. The jammed cobble rocks must be removed manually before augering operations can continue. For example, when a rock jam occurs, the auger must be removed from the casing and a worker must then crawl into the casing and manually removes the large cobble rock. Manually removing large cobble rocks increases auger down time.

To reduce the number of rock jams and to allow a worker to crawl through the casing to remove rock jams, a larger diameter auger and a larger diameter casing are used. However, larger diameter holes are more expensive to bore and are more disruptive to the environment.

Another problem with current auger machines involves the apparatus used for pushing casing. A large thrust force is required for pushing the casing through a bore hole. Thrust apparatus must also hold the rear end of the casing securely to the pushing unit. However, push arms such as shown in U.S. Pat. No. 3,162,254 to Rose, only push against a small area at the rear end of the casing. Thus, full thrust force from the drive unit is not transferred to the entire rear end of the casing.

The push arms also tend to buckle or otherwise damage the rear end of each casing. A damaged casing is difficult to weld to additional casing sections attached to the rear end of the casing.

Hammers are used for boring through solid rock. However, many drilling locations include different combinations of solid rock, cobble rock and dirt. In loose dirt, the back and forth motion of the hammerhead tends to pack loose cobble rock further into the dirt. However, the cobble rocks must be pulverized for effective boring. Thus, hammers are not always effective in boring through loose cobble rock and dirt.

Accordingly, a need remains for an inexpensive augerless boring system that is more effective in drilling through different soil compositions.

SUMMARY OF THE INVENTION

An augerless boring system provides effective drilling in a wide variety of soil compositions. The boring system comprises relatively slender circular drill steel attached at a front end to a hammer. The hammer holds different drill bits. The drill steel and the hammer are located inside a casing and driven along with the casing by a power and advance unit.

The hammer extends through a stabilizer head which is attached to the forward most casing section. The stabilizer head keeps the hammer and the drill steel centered in the casing and holds the drill bit partially extended out the front end of the stabilizer head.

The stabilizer head includes multiple elongated stabilizer bars extending lengthwise along the inside a stabilizer casing. The stabilizer bars are directed radially inward toward a central axis forming an inner circumference that aligns around the outside surface of the hammer. The stabilizer bars are either welded directly to the casing or are formed into a cage that can slidingly insert in and out of the casing.

A special thrust adapter is used for pushing the casing in a forward direction. The thrust adapter includes a back plate that mounts to the advance unit and an inclining ribs that extend radially inward from the back plate to a front plate.

A size adapter is coupled to the thrust adapter and includes a push plate that presses against substantially the entire rear end of the rearward most casing section. The push plate provides more distributed pressure to the rear end of the casing for more effective thrust of the casing into the bore hole while at the same time reducing damage to the rear end of the casing.

The size adapter also includes a mounting sleeve that holds different diameter casings more securely to the push plate. Different size adapters are attachably attached to the thrust adapter according to the specific casing diameters.

A special flushing system is used for removing earth material from the casing. The flushing system includes a swivel that attaches between the power and advance unit and the drill steel. The swivel includes a nozzle that directs air or water from the rear end of the casing through the drill steel and through the hammer. The flushing material flows out a front end of the hammer flushing soil and pulverized rock back through the rear end of the casing.

The forward thrust of the power and advance unit in combination with the rotational movement of the drill bit provide more effective drilling in a wider variety of different soil compositions. The distance that the drill bit is extended out of the drilling head is varied along with the forward thrust of the drive unit. When the drilling head protrudes further outside the front end of a front guide shoe, forward thrust is reduced. Protrusion of the drill bit is varied along with the forward thrust to maximize boring effectiveness in different soil compositions.

The foregoing and other objects, features and advantages of the invention will become more readily apparent from the following detailed description of a preferred embodiment of the invention which proceeds with reference to the accompanying drawings.

DETAILED DESCRIPTION

Figure 1:
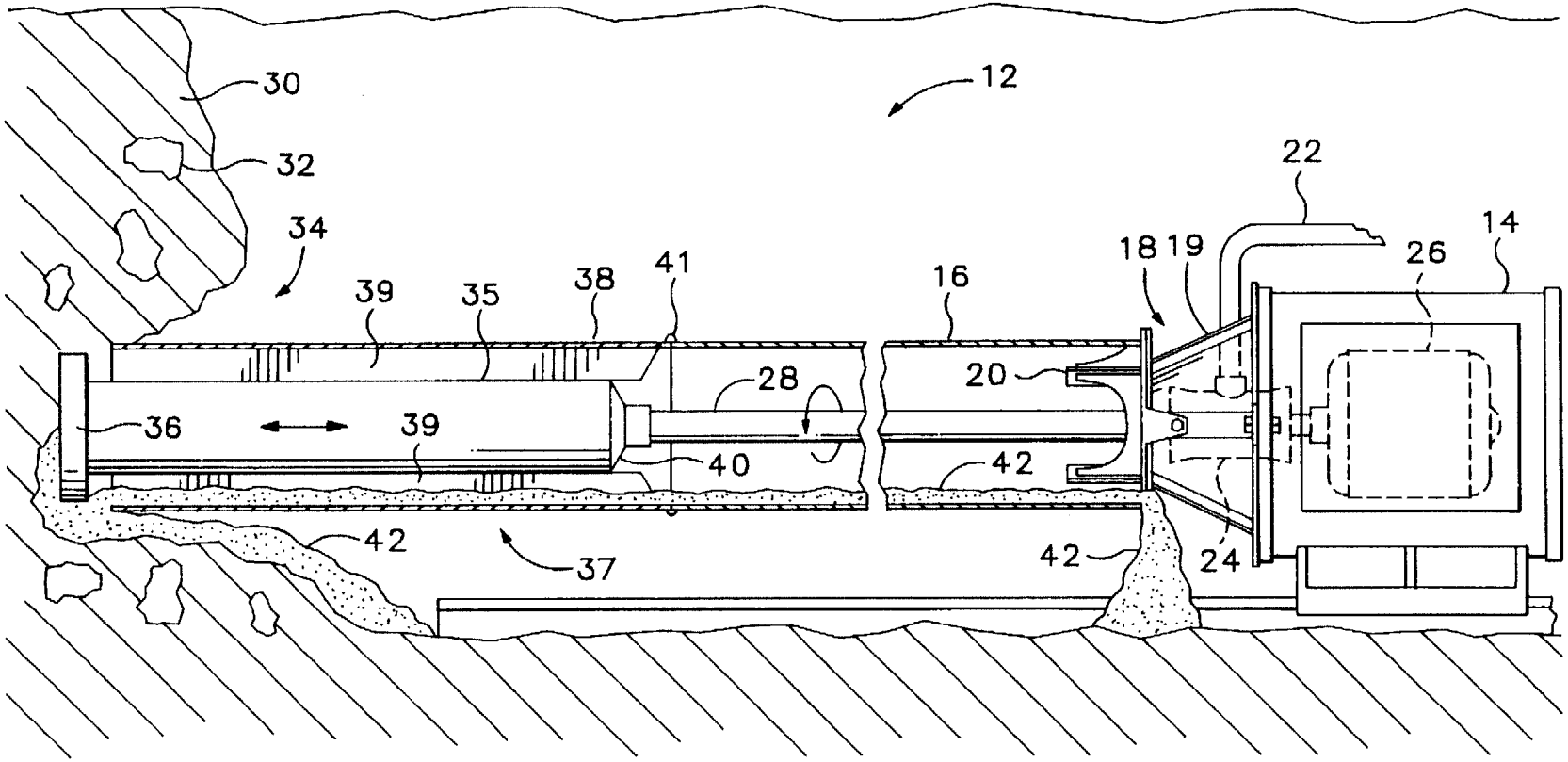
FIG. 1 is a diagram of an augerless boring system according to the invention.

FIG. 1 is a side view of an augerless boring system 12 according to the invention. A boring assembly includes tubular drill steel 28 having a threaded front end screwed into a hammer 40. A drill bit 36 screws into a front end of the hammer 40. A power and advance unit 14 is attached to the boring assembly and includes a drive motor 26 for rotating drill steel 28. The power and advance unit 14 is commercially available from a number of different manufactures such as American Augers, Inc. Wooster, Ohio 44691 and are well known to those skilled in the art.

The boring assembly extends through a casing 16. A thrust assembly 18 is coupled between the power and advance unit 14 and the rear end of casing 16. The thrust assembly 18 includes a thrust adapter 19 and a size adapter 20.

A swivel 24 is attached between the drive motor 26 and the rear end of drill steel 28. A hose 22 is attached to a nozzle on swivel 24 and transfers either water, air or other flushing materials. The flushing material is fed through a hole that extends through the length of drill steel 28 and hammer 40. In one embodiment of the invention, the flushing material comprises bentonite and is pumped through a mud pump (not shown) through hose 22. As will be discussed in more detail below, material pulverized by the drill bit 36 is flushed by the bentonite flushes material 42 back through the stabilizer head and through a back end of the casing 16.

A front end of the casing 16 is welded to a stabilizer head 37. The stabilizer head 37 includes a stabilizer casing 38 and stabilizer bars 39 extending longitudinally inside the stabilizer casing 38.

Thrust Adapter and Size Adapter

Figure 2:
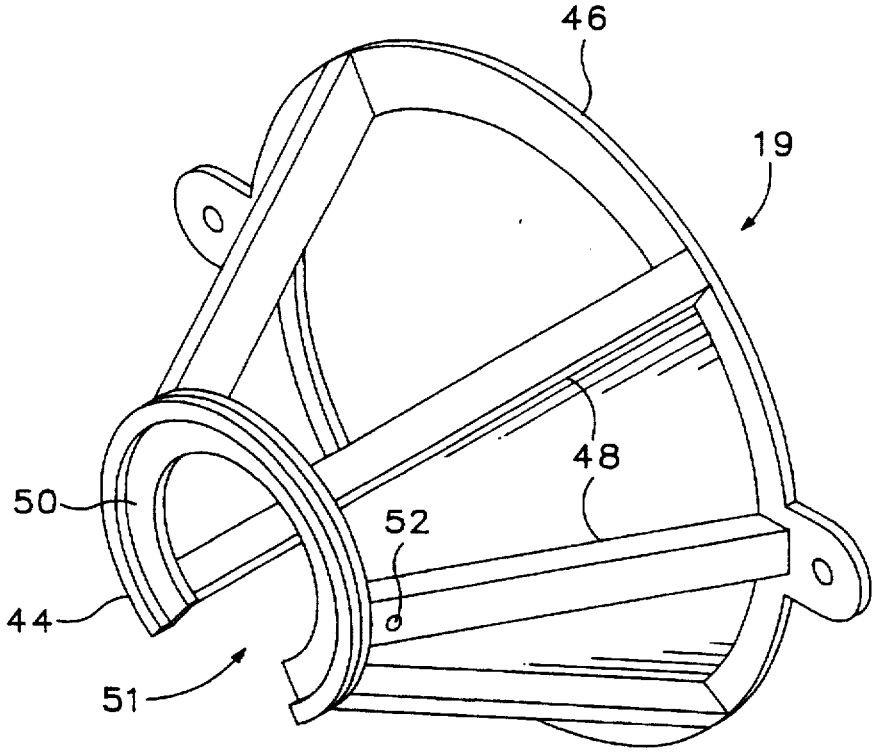
FIG. 2 is an detailed diagram of a thrust adapter for the boring system shown in FIG. 1.

FIG. 2 is a detailed diagram of the thrust adapter 19 shown in FIG. 1. The thrust adapter 19 is used by the power and advance unit 14 (FIG. 1) to push casing 16. The thrust adapter 19 includes a circular backplate 46 that bolts directly onto the advance unit 14. Multiple inwardly inclining ribs 48 each extend radially from the back plate 46 and connect at a front end to a circular front plate 50. A circular front lip 44 protrudes around the front plate 50.

Figure 3:
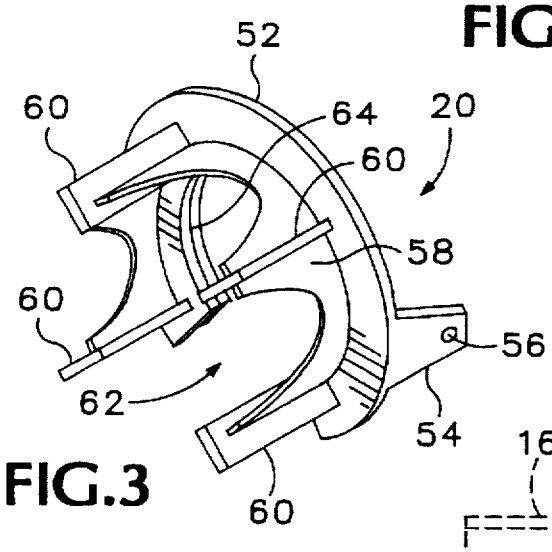
FIG. 3 is a detailed perspective view of a size adapter attached to the thrust adapter shown in FIG. 2
Figure 4:
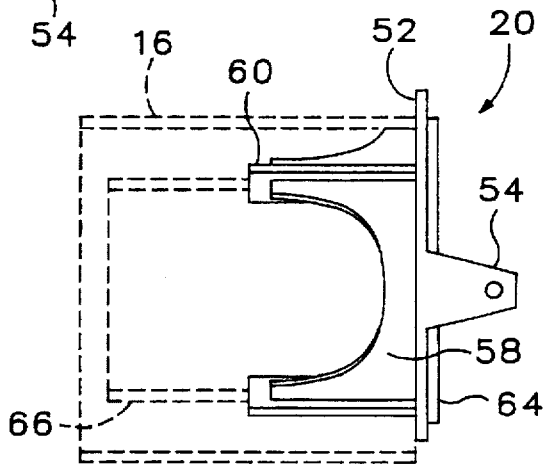
FIG. 4 is a side view of the size adapter shown in FIG. 3.

FIGS. 3 and 4 are detailed diagrams of the size adapter 20 that bolts onto the front end of thrust adapter 19. The size adapter 20 includes a circular push plate 52 that abuts against the rear end of the casing 16 which is shown in dashed lines. A smaller diameter casing 66 is also shown in dashed lines. A mounting sleeve 58 is welded to the push plate 52 and holds the different diameter casings 16 and 66 in a set position on the push plate 52.

The mounting sleeve 58 extends around a hole 62 in the mounting plate 52. Multiple ribs 60 extend radially around the push plate 52 and through the mounting sleeve 58 forming a first small circumference inside the mounting ring 20 and a second larger circumference around the outside of collar 58. Ears 54 are formed on opposite sides of the push plate 52 and include bolt holes 56 that align with bolt holes 52 on the ribs of thrust adapter 19 (FIG. 2). A rear lip 64 extends rearwardly from the push plate 52 and aligns inside the front lip 44 on thrust adapter 19.

The thrust adapter 19 is bolted onto the front end of the power and advance unit 14. The wide circular base provided by mounting plate 46, in combination with the inwardly inclined ribs 48, provide a stable platform that directs forward thrust from a large surface area on the front of advance unit 14 directly inward toward the rear end of the casing 16 (FIG. 1).

The size adapter 20 is placed over the front end of thrust adapter 19 so that lip 64 aligns with lip 44 on front plate 50. The bolt holes in ears 54 are aligned with bolt holes 52 on the side ribs 48 of thrust adapter 19. The size adapter 20 is then bolted to thrust adapter 19. A hole 51 in thrust adapter 19 and the hole 62 in size adapter 20 provide an opening for the drill steel 28 to extend from the power and advance unit and into the casing 16.

As described above, the mounting sleeve 58 in combination with ribs 60 secure different diameter casings to push plate 52. For example, in one embodiment, the inside circumference formed by the ribs 60 on the inside of sleeve 58 slide around the outside of an 8 inch diameter casing 66 (FIG. 4). The ribs 60 keep the casing from moving laterally side-to-side on the push plate 52.

The outside circumference formed by ribs 60 on the outside of mounting sleeve 58 slidingly insert inside a 12 inch. diameter casing 16 (FIG. 4). The ribs keep the casing 16 from moving laterally side-to-side on push plate 52. Different size adapters, similar to size adapter 20, are interchangeably attached to thrust adapter 19.

A larger size adapter can be bolted to thrust adapter 19. The larger size adapter includes generally the same push plate shape, mounting sleeve shape and rib shape. Only the overall dimensions of the components are larger. In an alternative embodiment, the inside circumference formed by the ribs 60 inside the mounting sleeve 58 are sized to fit around a casing having a 14 inch diameter. Accordingly, the outside diameter formed by the ribs 18 on the outside of mounting sleeve 58 insert snugly inside a 16 inch diameter casing.

The specific dimensions of size adapter 20 depend on the diameter of the casing being used.

The push plate 52 is substantially round and abuts against substantially the entire rear end of the casing 16 or 66. Therefore, force from the power and advance unit 14 is distributed uniformly around substantially the entire rear end of the casing. Therefore, the casing is less likely to be bent, buckle and in general be damaged while being pushed by the thrust adapter 19. The opening at the bottom of plates 50 and 52 allow material 42 (FIG. 1) to flow out the back end of casing 16.

Stabilizer Assembly

Figures 5, 6:
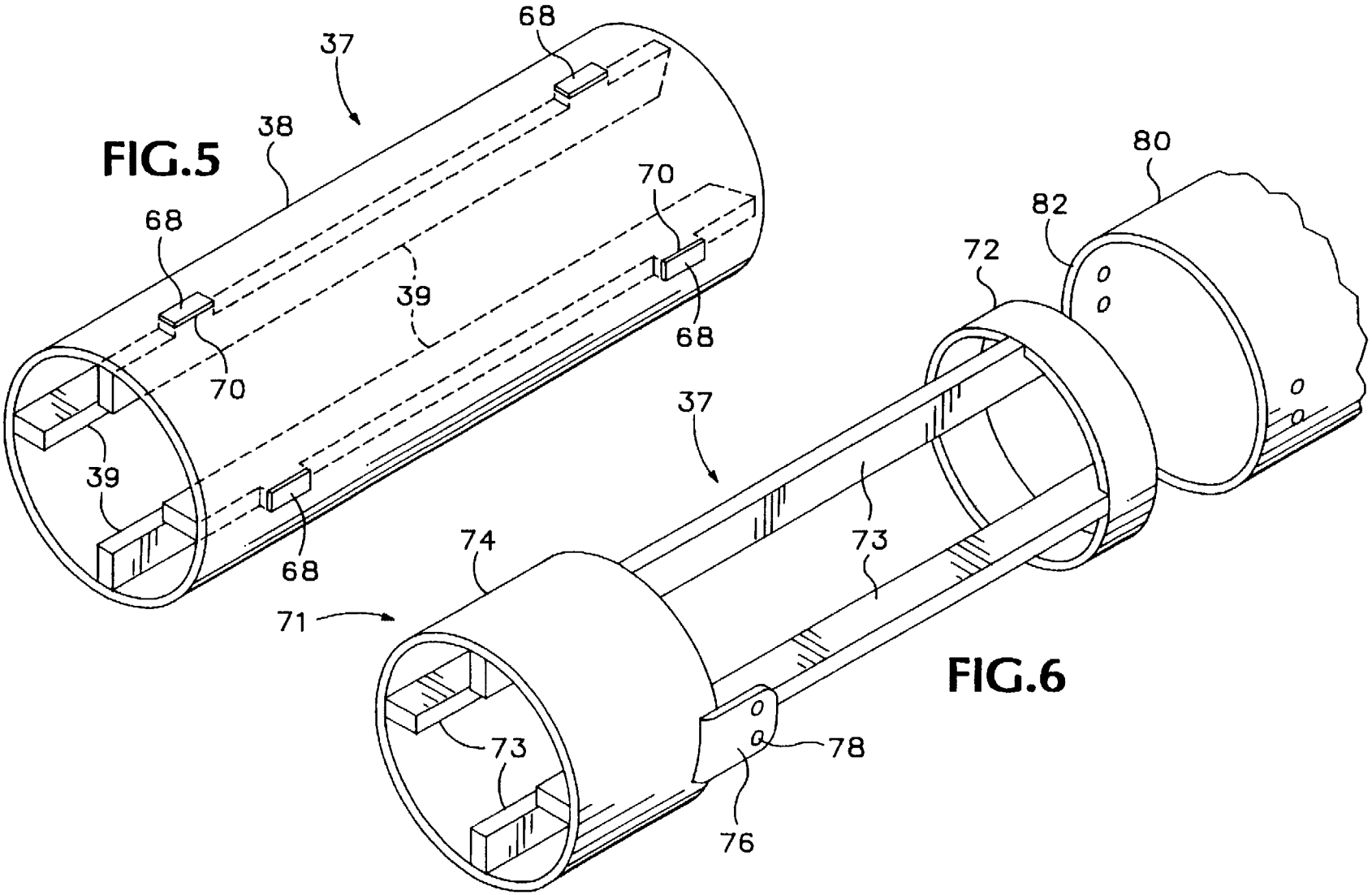
FIG. 5 is a detailed perspective view of a stabilizer head for the boring system shown in FIG. 1.
FIG. 6 is another embodiment of a stabilizer head according to the invention.

Referring to FIG. 5, one embodiment of the stabilizer head 37 includes a stabilizer casing 38 substantially the same diameter at casing 16. Stabilizer bars 39 extend lengthwise along substantially the entire inside surface of the stabilizer casing 38. Each stabilizer bar 39 extends radially inward toward a central casing axis. The stabilizer bars form an inner circumference that aligns around the outside surface of hammer 40, holding hammer 40 in the center of stabilizer casing 38. In one embodiment, the inside circumference formed by the stabilizer bars 39 is between 6 inches and 10 inches in diameter corresponding to a hammer of substantially the same diameter.

Each stabilizer bar 39 includes flanges 68 that extend through holes 70 in the stabilizer casing 38. Each flange 68 is inserted through corresponding holes 70 and then welded to the outside surface of stabilizer casing 38. After extended use, the stabilizer bars 39 wear down and require replacement. The flanges 68 are unwelded from the stabilizer casing 38 and removed from holes 70. New stabilizer bars 39 are then inserted into the stabilizer casing 38, the flanges 68 inserted into the same holes 70, and the flanges welded to the outside surface of the stabilizer casing 38.

Another embodiment of the stabilizer head 37 is shown in FIG. 6. The stabilizer head comprises a cage 71 that is slidingly insertable and removable from the inside of casing 80. The stabilizer cage 71 includes a rear ring 72 welded to a rear end of three stabilizer bars 73 similar to stabilizer bars 39 shown in FIG. 5. A front ring 74 is welded to a front end of each one of the stabilizer bars 73. Two ears 76 extend from opposite sides of front ring 74 and include bolt holes 78 that align with corresponding bolt holes 83 in a front end 28 of casing 80.

The rear ring 72 has an outside diameter slightly smaller than the inside diameter of casing 80 and front ring 72 has a diameter about equal with the diameter of casing 80. The rear ring 72 and stabilizer bars 73 are slidingly inserted into the casing 80 until the front ring 74 abuts against the front end 82 of casing 80. In the fully inserted position with front ring 74 abutted against casing 80, the ears 76 extend over the front end of casing 80. The bolt holes 78 in ears 76 are aligned with the bolt holes 83 in casing 80 so that the cage 71 can be bolted to casing 80. The hammer 40 is then inserted through and supported by the stabilizer cage 71 in a manner similar to the stabilizer head 37 shown in FIGS. 1 and 5.

The stabilizer cage 71 is detachably bolted into casing 80. Therefore, after the stabilizer bars 73 become worn, the cage 71 can be quickly unbolted and removed from casing 80. A new stabilizer cage is then quickly reinserted into casing 80 without welding. After the stabilizer cage 71 is removable from casing 80, the stabilizer bars are easier to remove and new stabilizer bars easier to install. Thus, the removable stabilizer cage reduces maintenance costs.

Both the stabilizer head 37 shown in FIG. 5 and the stabilizer cage 71 shown in FIG. 6 hold the entire length of hammer 40 in a stable centered position at the front end of the augerless boring system. The increased stability provides more accurate control of the drill bit 36. For example, drill bit 36 is less likely to wonder out of a centered alignment while boring through soil. Thus, holes can be bored straight through soil.

Figure 7:
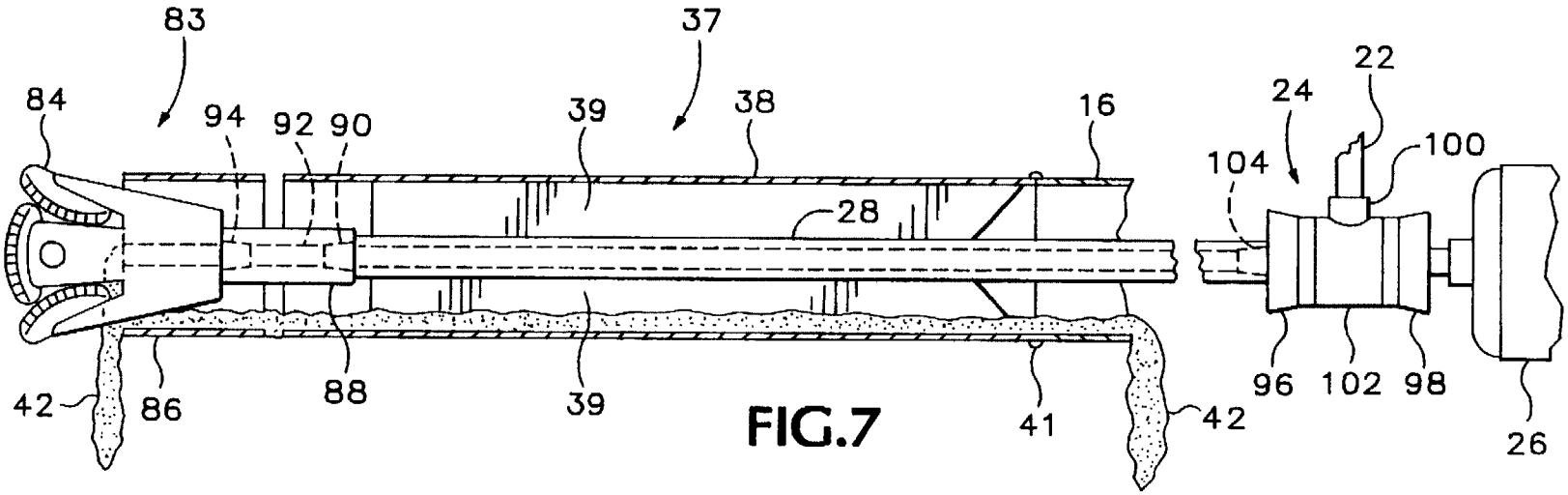
FIG. 7 is another embodiment of the boring system shown according to the invention.

FIG. 7 shows a boring assembly 83 according to another embodiment of the invention. A well drill bit 84 is attached through a reducer 88 to a front end of drill steel 28. The stabilizer bars 39 are sized to fit directly around drill steel 28 inside casing 16 and are offset back from the front end of casing 16 to receive reducer 88. A drive shoe 86 abuts against the front end of casing 16 and provides additional lateral stability for drill bit 84.

A center hole 90 in drill steel 28, a center hole 92 in reducer 88 and a center hole 94 in drill bit 84 are all threaded together forming a continuous channel for directing a flushing material. The swivel 24 includes a front end 96 and a rear end 98 that are connected by an axle inside center section 102. The rear end 98 is rotated by drive motor 26, in turn, rotating the front end 96. The center section does not move during rotation of the front and rear ends keeping a tube 100 in a stationary position for connecting to hose 22 (FIG. 1). A threaded nozzle 104 screws into the rear end of drill steel 28. Fluid or air is output from hose 22 into a nozzle 100 of swivel 24 and through the center hole 90 in drill steel 28.

Operation

Referring to FIG. 1, the stabilizer head 37 is welded at location 41 to the front end of casing 16. The hammer 40 and drill steel 28 are then inserted through casing 16 and stabilizer head 37. The drill bit 36 is then attached to the front end of hammer 40 or drill bit 84 connected to the front end of drill steel 28 (FIG. 7). Swivel 24 is attached to drive motor 26 at a rear end. The thrust adapter 19 is connected to the front end of power and advance unit 14 and the size adapter 20 is bolted to the front of the thrust adapter. The drill steel 28 is screwed into the front nozzle 104 of swivel 24.

The power and advance unit 14 is activated initiating rotation and selective horizontal oscillation in drill steel 28 via swivel 24. The hammer 40 at the front end of the drill steel rotates or, in addition, oscillates back and forth, in turn, rotating or oscillating drill bit 36. At the same time, flushing material 42, such as bentonite, is pumped via a mud pump (not shown) through hose 22 into swivel 24.

As shown in detail in FIG. 7, the hole 90 extends through the center of drill steel 28. The bentonite pumped from the swivel nozzle 104 flows through the center hole in drill steel 28 and out a front end. Reducer 88 is threaded to mechanically interlock the drill bit 84 with front end of drill steel 28. The reducer 88 also includes a center hole that fluidly connects the hole through drill steel 28 with the hole in drill bit 84.

The bentonite flow works in a similar manner in FIG. 1. For the embodiment shown in FIG. 1, the hammer 40 includes a center bore that is fluidly connected to the front end of drill steel 28. The bentonite flows through the drill steel 28, through hammer 40 and out a front of the hammer. The bentonite is pumped at approximately 150 pounds per square inch (psi).

The boring assembly is rotated and/or horizontally oscillated and the boring assembly and the casing 16 thrust in a forward direction into soil 30 all at the same time. The drill bit 36 pulverizes cobble rocks 32, solid rock or any other material in the soil. The pulverized cobble rock 42 along with dirt is flushed by the bentonite back through stabilizer head 37 and casing 16. The bentonite replaces the auger in dredging pulverized materials out the back end of casing 16. Since no auger is used, cobble rocks will not jam between the casing 16 and the auger.

As the system bores into soil 30, additional sections of casing are welded to the rear end of casing 16 and additional sections of drill steel 28 are screwed into the rear end of drill steel 28.

The boring operation can be varied according to soil composition and the diameter of the bore hole 34. Typical sections of casing 16 are between 12 and 36 inches in diameter and about 20 feet long. The drill steel 28 is typically joined in sections between 5 feet and 20 feet long and around 4 inches in diameter. In one embodiment, the stabilizer head 37 has a 20 foot long stabilizer casing and includes stabilizer bars that are about 5 feet to 8 feet long and about ¾ inches thick.

The following figures were found to provide optimum performance of the augerless boring system.

| | | | |
|---|---|---|---|
| RPM (rotation speed of drill steel) | 40 | 30 | 20 |
| PSI (pump pressure into swivel 24) | 1000 | 1600 | 2200 |
| THRUST (pounds exerted by power and advance unit) | 37,500 | 2200 | 82,500 |

It was discovered that as the drill bit 36 protruded further outside the front end of stabilizer head 37, the thrust requirement was lowered. It was also discovered that performance was optimized at a push speed from the power and advance unit of about one foot every 45 seconds.

To vary the boring capacity of the drill bit 36 for different soil compositions, protrusion of the drill bit out of the front end of the stabilizer head was varied. For example, for loose dirt, it was found that extending the drill bit further out of either the drive shoe or front end of the stabilizer head improved boring capacity. Alternatively, in solid rock or more compact soil compositions, boring capacity was improved by retracting the drill bit further back into the drive shoe 86 or stabilizer head 37.

Having described and illustrated the principles of the invention in a preferred embodiment thereof, it should be apparent that the invention can be modified in arrangement and detail without departing from such principles. I claim all modifications and variation coming within the spirit and scope of the following claims.

I claim:

1. An assembly for pushing a casing in an augerless boring system, comprising:

a thrust adapter including a back plate for mounting on a drilling advance unit and an extension assembly extending in a forward direction from the back plate; and a size adapter coupled to the thrust adapter, the size adapter including a push plate for pushing an aft end of the casing and a mounting sleeve welded onto the push plate and extending forward from the push plate for holding different diameter casings in a stationary position on the push plate.

2. An assembly according to claim 1 wherein the back plate comprises a metal ring and the extension assembly comprises multiple ribs extending radially inward around the metal ring to a front substantially circular front plate.

3. An assembly according to claim 2 including a substantially circular front lip extending from the front plate.

4. An assembly according to claim 1 wherein the size adapter is sized to detachably bolt to a front end of the extension assembly.

5. An assembly according to claim 4 wherein the size adapter includes ears formed on opposite sides of the push plate that bolt to opposite sides of the extension assembly.

6. An assembly according to claim 1 wherein the push plate includes a center hole and the mounting sleeve extends outward from the push plate around the center hole.

7. An assembly according to claim 6 including multiple ribs extending radially through the mounting sleeve forming a first circumference inside the mounting sleeve having a first diameter and a second circumference outside the mounting sleeve having a second diameter.

8. An augerless boring system, comprising:

at least one stabilizer casing elongated about a central axis for inserting into a bore hole while retaining a boring assembly; and multiple elongated stabilizer bars extending longitudinally inside the stabilizer casing, the stabilizer bars directed radially inward toward the central axis and forming an inside circumference for supporting and centering the boring assembly in the stabilizer casing.

9. A system according to claim 8 wherein the stabilizer bars are slidingly insertable and removable inside the stabilizer casing.

10. A system according to claim 8 including a rear stabilizer ring joined to a rear end of each one of the stabilizer bars and a front ring joined to a front end of each one of the stabilizer bars, the rear stabilizer ring and the stabilizer bars slidingly insertable inside the stabilizer casing.

11. A system according to claim 10 wherein the front ring abuts against a front end of the stabilizer casing when the stabilizer bars and rear ring are fully inserted in the stabilizer casing.

12. A system according to claim 10 including ears extending from the front ring for bolting to an outside surface of the stabilizer casing.

13. A system according to claim 8 including at least one casing extension welded at a front end to a rear end of the stabilizer casing and pushed at a rear end by a power and advance unit.

14. A system according to claim 13 wherein the boring assembly comprises drill steel extending from the power and advance unit through the casing extension and a hammer coupled to the drill steel, the drill hammer extending along substantially the entire length of the stabilizer bars and having an outside circumference substantially equal to the inside circumference formed by the stabilizer bars.

15. A system according to claim 13 including a thrust adapter and a size adapter detachably coupled to the thrust adapter, the thrust adapter and Size adapter located between the power and advance unit and the rear end of the casing extension, whereby the size adapter is snugly insertable inside a first casing having a large diameter and snugly attachable around a second casing having a smaller diameter than the first casing.

16. An assembly according to claim 8 wherein each stabilizer bar includes flanges that extend through the stabilizer casing and are welded to an outside surface of the stabilizer casing.

17. An augerless boring system, comprising:

a boring assembly having a front end and a rear end and a hole extending longitudinally through the boring assembly;

a drill bit attached to the front of the boring assembly for boring through the ground material;

a power and advance unit joined to the rear end of the boring assembly;

casing retaining the boring assembly, the casing having a front end and a rear end, the rear end contacting the power and advance unit; and a nozzle attached to the rear end of the boring assembly that engages with the center directing fluid through the boring assembly for flushing ground material pulverized by the drill bit back through the casing out the rear end of said casing.

18. A boring system according to claim 17 including a thrust assembly for pushing the casing in a forward direction, the thrust assembly including the following:

a back plate for mounting on the power and advance unit;

multiple ribs extending radially around the back plate each inclining inward in a forward direction from the back plate to a front plate; and a size adapter detachably coupled to the extension assembly, the size adapter including a push plate for pushing a rear end of the extension casing and a mounting sleeve rigidly welded to the push plate for slidingly attaching and holding different diameter casings on the push plate.

19. A boring system according to claim 18 wherein the boring assembly includes tubular drill steel attached at a front end to an elongated tubular hammer having a given length.

20. A boring system according to claim 19 including multiple elongated stabilizer bars extending lengthwise inside the stabilizer casing along substantially the entire given length of the hammer, the stabilizer bars directed radially inward toward the central casing forming an inside circumference.

21. A boring system according to claim 17 wherein the nozzle comprises a swivel attached between the power and advance unit and the rear end of the boring assembly.

22. A boring system according to claim 17 including a front stabilizer head attached to the front end of the casing and holding the boring assembly in a centered position in the casing while the drill bit extends out a front end of the stabilizer head.

* * * * *